US005320449A

United States Patent [19]

Demarteau

[11] Patent Number: 5,320,449

[45] Date of Patent: Jun. 14, 1994

[54] DEVICE DESIGNED TO CREATE A MOVEMENT IN A LIQUID ESPECIALLY AT ITS SURFACE

[75] Inventor: Joseph Demarteau, Namur, Belgium

[73] Assignee: S.A. Wow Company, Namur, Belgium

[21] Appl. No.: 930,384

[22] PCT Filed: Mar. 15, 1991

[86] PCT No.: PCT/BE91/00020

§ 371 Date: Sep. 11, 1992

§ 102(e) Date: Sep. 11, 1992

[87] PCT Pub. No.: WO91/14062

PCT Pub. Date: Sep. 19, 1991

[30] Foreign Application Priority Data

Mar. 15, 1990 [BE] Belgium ..... 9000297

[51] Int. Cl.[5] ..... E02B 3/00; E04H 4/00

[52] U.S. Cl. ..... 405/79; 4/491

[58] Field of Search ..... 405/79, 52, 76, 80; 4/491

[56] References Cited

U.S. PATENT DOCUMENTS 3,477,233 11/1969 Andersen .
4,201,496 5/1980 Andersen .
4,375,337 3/1983 Yerger .
4,507,018 3/1985 Andersen .

FOREIGN PATENT DOCUMENTS 236653 9/1987 European Pat. Off. .
2302151 9/1976 France .
2572809 5/1986 France .
169274 8/1934 Switzerland .

*Primary Examiner*—David H. Corbin
*Attorney, Agent, or Firm*—Sughrue, Mion, Zinn, Macpeak & Seas

[57] ABSTRACT

The present invention relates to a device intended to create a motion in a liquid, in particular at the surface thereof, this liquid being contained within a tank defined by one or more walls, in particular in a swimming pool, this device comprising an element in contact with the liquid in which, in particular at the surface of which, a motion is to be created. The device according to the invention comprises, as an element, a floating or submerged assembly which is not solidly fixed to a wall of the tank, the said assembly comprising two bodies (1,5) mutually connected by at least one means (7), this means (7) being intended to move the bodies (1,5) relative to one another in a manner such as to create a motion in the liquid, in particular at the surface thereof.

25 Claims, 8 Drawing Sheets

DEVICE DESIGNED TO CREATE A MOVEMENT IN A LIQUID ESPECIALLY AT ITS SURFACE

The present invention likewise relates to an assembly emitting a signal at the moment when a body, in particular a floating body, has to be pushed in a liquid in which, or at the surface of which, a motion is to be created, so that the deviation between the moment at which a wave or motion passes through a specified state and the moment of pushing corresponds to a determinate value. This assembly advantageously comprises an acceleration sensor connected to an electronic chip or microprocessor.

STATE OF THE ART

Document EP-A-0 236 653 has disclosed a system for generating an artificial swell in a tank. This system comprises a jack solidly fixed to a wall of the tank, the shaft of the piston of the jack carrying a float. The jack thus imparts to the float an alternating motion in a single horizontal plane.

The use of a system of this type in a swimming pool requires substantial work along one wall of the latter.

On the other hand, the use of a system of this type in a swimming pool will have only a random effectiveness. This is because, during the return of a wave (which return is caused by the reflection of a wave from a wall), a plurality of cases are possible, including inter alia:

- the float acts during the return of the wave towards the said float, so that the motion of the float opposes the return motion of the wave, that is to say that the energy of the float is used to oppose the return motion of the wave;
- the float acts in the trough of a wave, so that the power transmitted by the float to the liquid to be set in motion is slight, since the float is still moving in a single horizontal plane.

Finally, since the float remains in a single horizontal plane, such a float acts as a barrier or energy absorber for a reflected wave.

A device for a swimming pool is likewise known which is contituted by a substantially vertical panel connected to one wall of the pool, firstly by an articulation and secondly by a jack. This known device makes it possible to create waves at the surface of the pool. This device requires substantial infrastructural work. Moreover, the energy transmitted to the liquid will depend on the level of the wave in contact with the panel. Such a device consumes a great deal of energy in order to create waves.

The present invention relates, inter alia, to a device which requires only little energy to create waves, for example in a swimming pool. In fact, the device according to the invention makes it possible, inter alia, to optimise the utilisation of energy to create motions at the surface of a swimming pool.

This is because, in the case of a swimming pool, the device according to the invention is not solidly fixed to a wall of the pool and does not create, as such, a static obstacle to the motions created. It may nevertheless become a dynamic obstacle in one particular form of use, in which the motion of movement of the bodies of the device is controlled to be one quarter-cycle behind relative to the motion of the waves. Finally, the operation of the device may be controlled in order to obtain maximum effectiveness. Thus, it if is desired to obtain motions of maximum amplitude, the device according to the invention will be controlled to be one quarter-cycle ahead relative to the motion of the waves created.

BRIEF DESCRIPTION OF THE INVENTION

The device according to the invention is a device intended to create a motion in a liquid, in particular at the surface thereof, this liquid being contained within a tank defined by one or more walls, in particular in a swimming pool. The device comprises an element in contact with the liquid in which, or at the surface of which, a motion is to be created. This element is a floating or submerged assembly, not solidly fixed to a wall of the tank, the said assembly comprising two bodies mutually connected by at least one means, this means being intended to move the bodies relative to one another in a manner such as to create a motion in the liquid, in particular at the surface thereof.

An assembly not solidly fixed to a wall of the tank is understood to mean two bodies mutually connected by a means which forms a floating or submerged assembly free of any motion in the liquid or at the surface thereof, but likewise two bodies mutually connected by a means which forms a floating or immersed assembly whose motion in the liquid or at the surface of the liquid is limited in a manner such as to permit a particular positioning of the floating or immersed body in the liquid or at the surface thereof (anchoring of the device according to the invention, for example, by means of a cord in order to obtain the positioning of the device in a determinate volume of the liquid or a determinate zone of the surface of the said liquid).

The first body is advantageously a shell in which the second body moves.

Preferably, the device likewise comprises a means intended at least partially to compensate the gravity effect of the second body on the first body. This means is, for example, constituted by a resilient element placed between the bottom of the first body and a face of the second body. Advantageously, the said means is a spring one end of which bears on the bottom of the first body, while a face of the second body, substantially parallel to the said bottom, rests on the other end of the spring.

Advantageously, the device according to the invention comprises a system for controlling the movement of the bodies relative to one another. Such a system may comprise at least one sensor selected from among the sensors intended to evaluate the amplitude of the waves, such as an echo depth sensor, sensors intended to evaluate the relative movement of the bodies one to the other, sensors intended to evaluate the position (level) of the first body in the liquid, accelerometers, etc.

In one form of embodiment, the first body is a vessel possessing a bottom connected to the second body by a jack, the displacement of the stem of the latter causing the movement of the bodies relative to one another.

In another form of embodiment, the device according to the invention comprises a means constituted by a geared motor carried by a first body, the said geared motor driving in rotation a shaft carrying a crank, a connecting rod extending between the said crank and the second body. In this form of embodiment, the geared motor is advantageously a variable-speed geared motor.

The device according to the invention advantageously comprises a control system. Such a system is, for example, a system comprising a unit for controlling the speed of the movement of the bodies relative to one another and a unit for controlling the phase of the movement of the bodies relative to one another relative to the phase of the movement created in the liquid or at the surface thereof.

In the case of a device comprising a means constituted by a geared motor driving in rotation a shaft carrying a crank connected to a connecting rod one end of which is connected to a body, the geared motor is advantageously equipped with a first sensor generating a frequency proportional to the speed of the motor driving the reducing gear and, preferably, with a second sensor called a synchronisation sensor emitting a signal when the connecting-rod/crank system is in an extreme position. The speed control unit and the phase control unit are connected to a sensor generating a frequency proportional to the speed of the geared motor, a second synchronisation sensor emitting a signal when the connecting-rod/crank system reaches an extreme position, and an acceleration sensor.

The speed sensor for the geared motor, or more precisely for the motor driving the reducing gear, and the synchronisation sensor may be of the type comprising a photoelectric cell, the said cell comprising a transmitter and a receiver between which moves part of a disc solidly fixed to the shaft of the motor driving the said reducing gear or the shaft of the reducing gear, the said disc possessing one or more notches or perforations permitting the receiver to receive a signal emitted by the transmitter.

In a preferred form of embodiment, the control system comprises an electronic chip or a microprocessor receiving, via cables, signals form the speed sensor for the geared motor, from the synchronisation sensor and from the acceleration sensor, and emitting a signal controlling the power supply to the variable-speed geared motor.

The electronic chip or microprocessor advantageously controls the power supply to the geared motor in a manner such as to permit regulation of the speed of the geared motor. In one form of embodiment, the said chip or the said microprocessor comprises:

- a memory for an index value of the speed of the geared motor for each revolution,
- a memory for the desired period of the geared motor (inverse of the frequency of rotation of the geared motor);
- a unit for determining the average period of the geared motor over a plurality of geared motor revolutions;
- a unit for determining the deviation existing between the average period and the desired period, and
- a unit for modifying the geared motor speed index memory as a function of the measured deviation in a manner such as to permit regulation of the speed of the geared motor.

Preferably, the electronic chip or microprocessor likewise comprises:

- a unit for processing signals coming from the acceleration sensor in which are determined a mean value over a determinate period of time and the minimum and maximum values of the said signals, and which, by means of these values, the moment is determined at which a wave of the motion at the surface of the liquid or a motion in the liquid passes through a predetermined state,
- a unit measuring the deviation between the said moment and the moment when the connecting-rod/crank system passes through an extreme state,
- if desired, an element for processing deviations in a manner such as to determine a mean deviation over a plurality of periods, and
- a system comparing this deviation or mean deviation with an optimum deviation, this system emitting a signal to the power supply of the geared motor, in a manner such as to correct the difference existing between the deviation or mean deviation and the optimum deviation, that is to say the moment at which the connecting-rod/crank system passes through an extreme state relative to the moment when a wave at the surface of the liquid or a motion in the liquid passes through the said predetermined state (for example, in the case of a swimming pool, the zero state, that is to say the state in which the wave in the liquid has achieved the average level).

Finally, the present invention also relates to an assembly making it possible to determine a moment at which a body has to be pushed in a liquid in which, or at the surface of which, a motion is to be created, in a manner such as to obtain a predetermined motion in the tank or swimming pool, in particular at the surface thereof.

Such an assembly may be used in a device according to the invention buy may likewise be used to emit a signal, such as a sound, indicating for example to a swimmer that he should submerge a floating body in order to obtain a predetermined motion, for example waves of maximum amplitude in a swimming pool.

The assembly comprises an acceleration sensor connected to an electronic chip or microprocessor.

The said chip or the said microprocessor advantageously comprises:

- a unit for processing signals coming from the acceleration sensor in which are determined a mean value over a determinate period of time and the minimum and maximum values of the said signals, and in which, by means of these values, the moment is determined at which a wave at the surface of the liquid or motion within the liquid passes through a predetermined state;
- a unit making it possible to deduce from these values resonance periods of the waves or of the motion of a liquid contained within a tank, and
- a system emitting a signal when the body has to be pushed in the liquid so as to obtain waves or a motion having a period close to a resonance period.

Other features and details of the invention will become apparent from the detailed description which follows and in which reference is made to the attached drawings.

DESCRIPTION OF FORMS OF EMBODIMENT

The device according to the invention is intended to create a motion in a liquid, in particular at the surface 8 of a liquid contained in tank defined by one or more walls. This device comprises an element in contact with the liquid in which, or at the surface of which, a motion is to be created.

Figure 1:
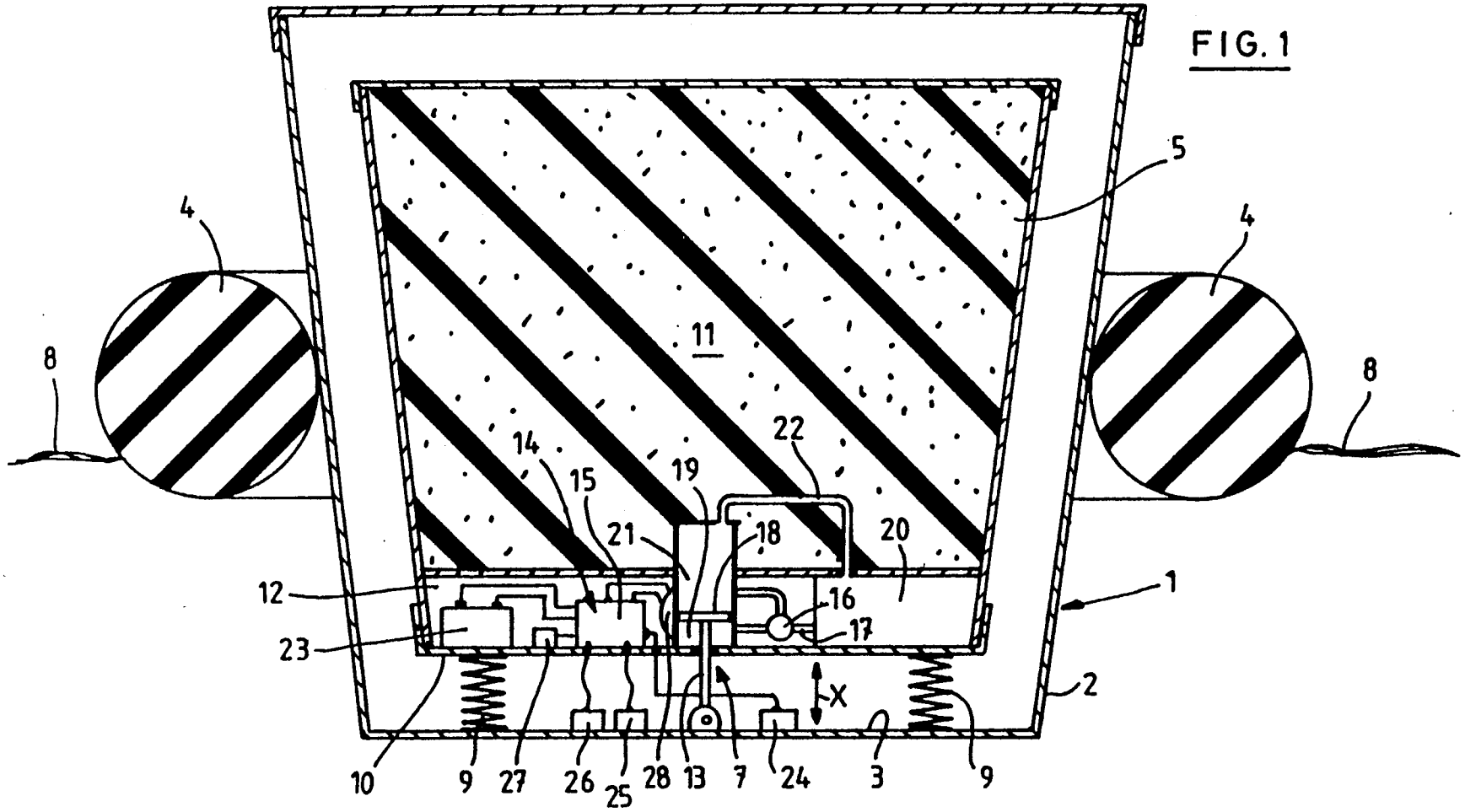
FIGS. 1 to 4 show different forms of embodiment of a device according to the invention.

In a form of embodiment shown in cross-section in FIG. 1, the element in contact with the liquid, at the surface of which, for example, a motion is to be created, is a floating assembly 1 not solidly fixed to a wall of the tank. This assembly comprises:

- a first body 1 which is in the form of a frustoconical shell or vessel 2 equipped with a bottom 3 and with a float ring 4;
- a second body 5 connected to the first body 1 by at least one means 7 intended to move the second body in the shell 2 relative to the bottom 3, the movement (X) of the bodies relative to one another creating a motion in the liquid, in particular at the surface 8 of a liquid, for example a sheet of water or a swimming pool.

The device according to the invention likewise comprises springs 9 intended at least partially to compensate the gravity effect of the second body 5 on the first body 1. These springs bear by one of their ends on the bottom 3 of the first body, while a face 10 of the second body 5 rests on the other end of the springs 9. Advantageously, the said face 10 is substantially parallel to the bottom 3 of the first body.

The second body comprises two chambers 11,12 separated from each other by a wall. The upper chamber 11 contains a water-filled foam, this water serving to increase the weight of the second body. It is self-explanatory that lead bars, etc., could have been used to increase the weight of the second body.

However, the use of a water-filled foam makes it possible, by evacuating the water, to reduce the total weight of the device when the latter is to be removed from a sheet of water or is to be moved.

The foam makes it possible to prevent the water contained in the chamber 11 from undergoing exaggerated motions.

The second chamber 12 or lower chamber contains a control system 14 for the movement of the stem 13 of the jack, this jack acting as a means 7 intended to move the bodies relative to one another. This control system 14 comprises a regulating device 15 for a pump 16 mounted on a pipe connecting the part 19 of the jack 7 situated beneath the piston 18 thereof to a reservoir 20. The part 21 of the jack situated above the piston 18 is connected to the reservoir 20 by a pipe 22.

The regulating device 15 for the pump 16 acts on the motor 28 driving the latter. This regulating device 15 regulates the energy supplied to the motor of the pump, this energy coming from a battery 23 placed in the second chamber 12.

When the regulating system 14 operates by means of a gas, or when the reservoir 20 is equipped with an elastic membrane, a simple system for at least partially compensating the gravity of the second body on the first is constituted by a jack connected to a reservoir whose volume is advantageously greater than three times that of the jack. The gas may be compressed air. The volume of the reservoir and the gas pressure will preferably be selected so as to obtain a substantially linear compensation effect.

A system capable of being used to move the bodies relative to one another comprises a production unit or a reservoir for compressed liquid or gas, this compressed liquid or gas being intended to actuate the jack. One example of a compressed air production unit is a unit in which a chemical and/or physical reaction takes place, such a unit being for example an internal combustion engine or a chamber in which calcium carbide is mixed with water.

Various sensors are connected to the regulating device 15 in order for the latter to be able to take into account the position of the bodies relative to one another, and the submersion or the acceleration imparted to the said device.

Thus, the device according to the invention is equipped with an accelerometer 24 or with a sensor 25 intended to evaluate the amplitude of the waves, such as an echo depth sensor, with a sensor 26 intended to evaluate the position (level) of the first body in the liquid, and with a sensor 27 intended to measure the movement of the bodies relative to one another.

The regulating device 15 makes it possible to synchronise the movement of the bodies relative to one another with the motion of the waves.

The second body 5 advantageously has a weight which is at least 5 times greater than the weight of the first body.

A device of the type shown in FIG. 1 was placed in a swimming pool. The first body was a cylindrical vessel 70 cm in height and 78 cm in diameter, this vessel being equipped with an inflatable ring 25 cm in diameter, this ring being fixed at half-height. The weight of this first body was 35 kg.

The second body had a weight of 170 kg and was moved relative to the first body by means of a motor of approximately 400 watts, while springs (spring constant: $\pm 25$ N/cm) compensated the gravity effect of the second body on the first.

The maximum movement of the bodies relative to one another was approximately 10.2 cm.

The speed of movement of the bodies relative to one another was regulated so that they move apart from one another more than at least 30 times per minute, in a manner such that the frequency of relative movement apart of the bodies is close to a resonance frequency of the waves (with 0.5%).

It was noted that once the device according to the invention was positioned and in operation at the surface of a swimming pool (50 $m^2$), it was possible to obtain after 3 to 5 minutes waves of approximately 80 cm in height. It was likewise noted that the device according to the invention tended, in the course of these tests, to position itself at the most favourable point in the pool for creating waves.

It is self-explanatory that, if the device was a device immersed in a liquid, it would be able to position itself at the most favourable point for obtaining maximum agitation in the liquid.

The device according to the invention as shown in FIG. 1 advantageously comprises a regulating system connected to an echo depth sensor, this system making it possible to synchronise the motion of the bodies relative to one another as a function of the position of the device relative to a wave.

The device according to the invention may likewise be used to create counter-waves, that is to say to create, for example, a motion at the surface of the water opposing naturally or artificially created waves.

The device according to the invention may likewise be used in multi-phase liquid systems such as systems comprising immiscible liquids of different densities. In this case, the device according to the invention is advantageously partially floating relative to the liquid of highest density.

Figure 2:
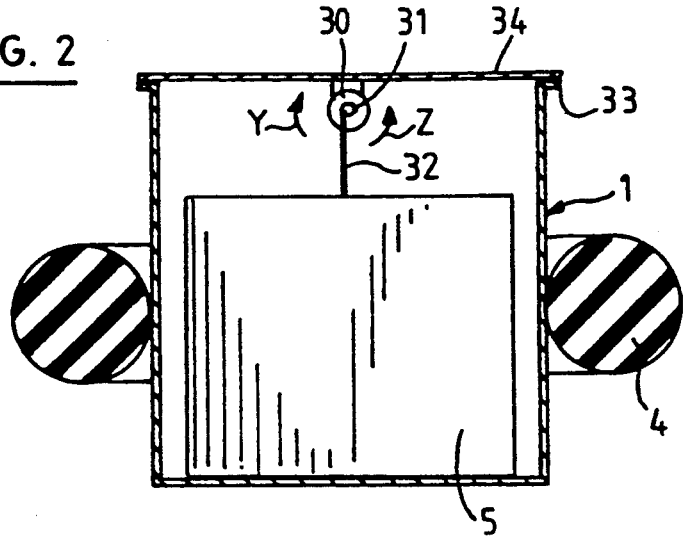

FIG. 2 shows the second form of embodiment of a device according to the invention.

In this form of embodiment the means 7 intended to move the first body 1 relative to the body 5 is constituted by a geared motor 30 driving in rotation a shaft 31, in the direction of the arrow Y, and a strap or cable 32 extending between the said shaft 31 and the second body 5. The geared motor 30 is mounted on a plate 34 carried by the upper rim 33 of the body 1.

The operation of this device is described below.

During a time $V_1$, the geared motor 30 is operated so that the strap 32 is wound around the shaft 31 in a manner such as to move the bodies 1,5 relative to one another.

After this time $V_1$ the current supplying the geared motor 30 is cut off so that, as a result of the action of gravity on the second body, the strap or cable 32 rapidly unwinds.

During the unwinding of the strap or of the cable, the shaft 31 is caused to rotate in the direction of the arrow Z. The rotation of this shaft makes it possible for the motor driving the reducing gear to act as a dynamo, which makes it possible to control, by means of a voltage measurement, the descent of the second body 5 relative to the first body 1.

When the second body 5 has completed its descent relative to the first body, the geared motor 30 is supplied with power in a manner such that it drives the shaft 31 in the direction of the arrow Z to cause the ascent of the body 5 relative to the body 1.

The operating cycle of the device according to the invention can thus continue.

In such a system, it is possible to act on the weight of the second body 5, on the upward travel of the second body, on the braking caused by the geared motor during the descent of the second body, and on the power of the motor driving the reducing gear, in order to obtain the desired period of motion.

Figure 3:
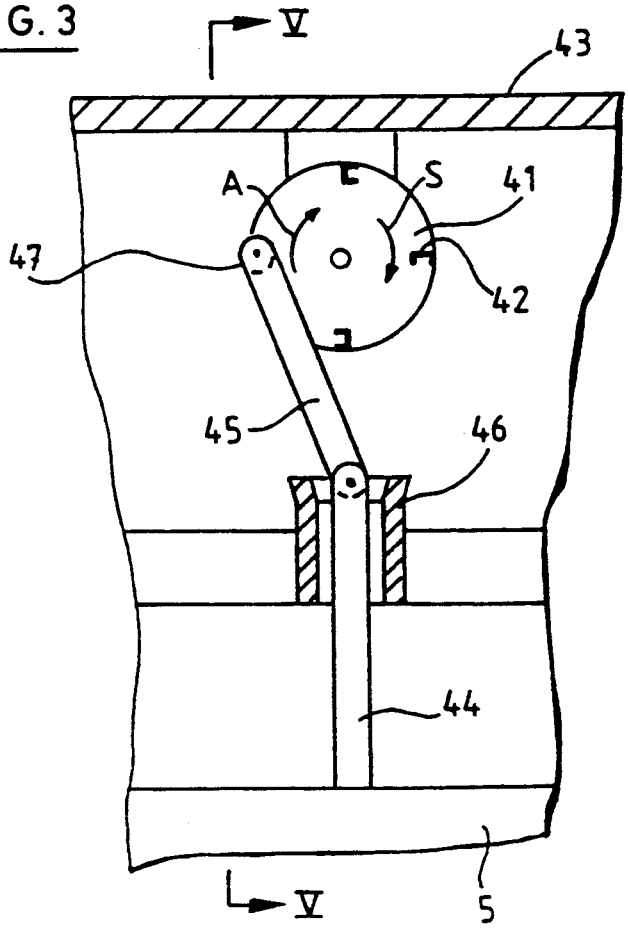
Figure 4:
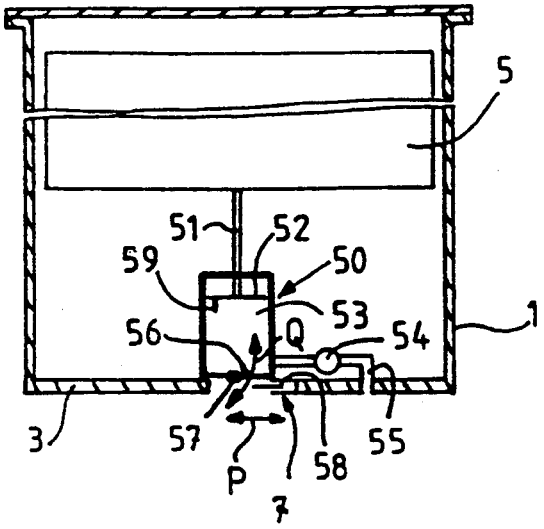

The FIGS. 3 and 4 show other means 7 which can be used to move the bodies 1,5 relative to one another.

In FIG. 3, the means 7 is a geared motor 40 driving in rotation a disc 41 carrying at its periphery four U-shaped angle pieces 42.

This geared motor 40 is solidly fixed to a plate 43 bearing on an upper rim of the first body 1.

The second body 5 is connected to a rod 44 on which is articulated an arm 45. The rod 44 is able to slide in a sleeve 46 solidly fixed to the first body 1. The arm 45 bears at its free end a finger 47 intended to be engaged in the groove of the U-shaped angles 42 (see FIG. 5).

The operation of such a device is as follows:

During a half-rotation A of the disc 41, the arm 45 and the rod 44 are drawn upwards, so that the second body 5 is lifted.

During the other half-rotation S of the disc, the finger 47 is no longer engaged in the groove of an angle 42 so that, by the action of gravity on the second body 5 the rod 44 and the arm 45 slide rapidly in the sleeve.

FIG. 4 is a sectional view of another alternative embodiment of a means 7 capable of being used in a device according to the invention.

This means 7 is constituted by a jack 50, the rod 51 of the piston 52 of the said jack being solidly fixed to the second body 5.

This jack 50, or more precisely the chamber 53 thereof situated below its piston 52, is connected to a pump 54 by a pipe 55.

When the device according to the invention is used in a swimming pool, this pump is able to draw water from the swimming pool in order to act on the piston.

The jack, which is advantageously solidly fixed to the bottom 3 of the body 1 possesses an end equipped with a trap 56 capable of pivoting about a shaft 57 (arrow Q). The closure of the trap 56 is provided by a latch 58 which is controlled electrically (motion of the latch in the direction of the arrow P).

When the piston is in the high position, the latch 58 is controllable in a manner such as to permit the trap 56 to pivot about the shaft 57.

The said pivoting or the opening of the trap occurs naturally by virtue of the action of gravity on the body 5, and by virtue of the fact that the shaft 57 is eccentric, that is to say that it is not situated along an axis of symmetry of the trap 56.

The action of gravity on the body 5 permits the water contained in the chamber 53 of the jack 50 to be evacuated until the moment when the finger 59 solidly fixed to the piston 52 touches an end of the trap and causes the pivoting thereof and the closure thereof by the latch.

The operating cycle can thus continue.

It is self-explanatory that, instead of using a jack as the means 7 intended to move the bodies 1,5 relative to one another, it would have been possible to use a system comprising a connecting rod, a crank connecting rod, a cam, etc.

A connecting-rod/crank system will, moreover, be described below for the device shown in FIG. 6.

Preferably, the center of gravity of the body 5 is close to the center of buoyancy or of floatation of the device, in a manner such as to ensure relative stability of the device, advantageously a perfectly stable equilibrium.

Figure 6:
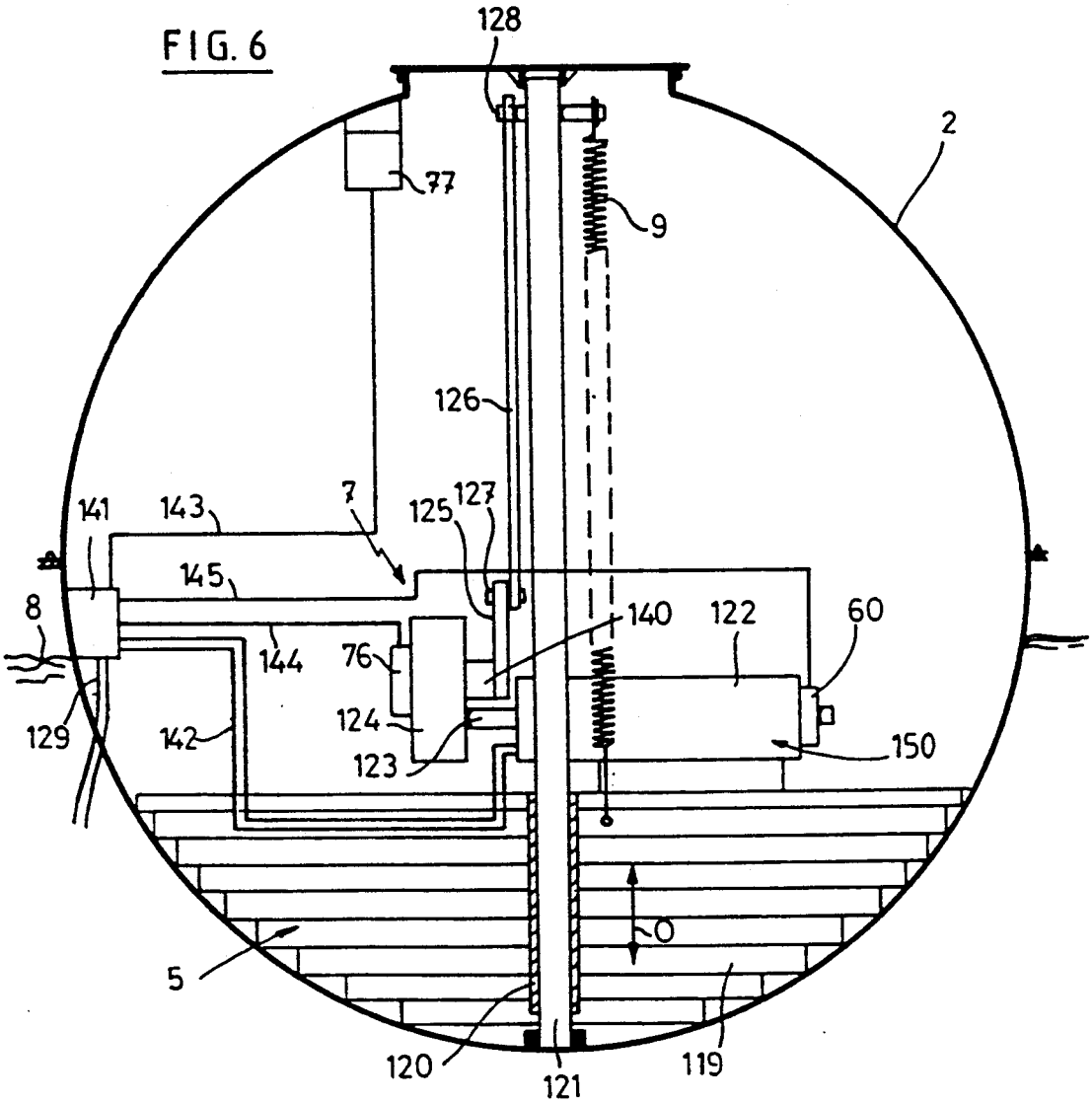
FIG. 6 is a view of another form of embodiment of a device according to the invention equipped with an electronic device.

FIG. 6 shows in cross-section another form of embodiment of a device according to the invention.

This device comprises a spherical shell 2 and a body 5 connected to the shell 2 by a means 7.

The body 5 consists of a series of discs 119 possessing a central perforation in which is placed an Ertalon® mandrel 120, the central aperture of the mandrel allowing the passage of a guide rod or bar 121 solidly fixed to the shell 2. The use of Ertalon makes it possible to restrict the frictional forces existing during the sliding of the mandrel along the rod 121.

The means 7 comprises:

a motor 122 mounted on the second body 5, the shaft 123 of which drives a reducing gear 124, the motor/reducing gear assembly being designated hereinafter by the reference notation 150;

a crank 125 driven by the shaft 140 of the reducing gear 124, and a connecting rod 126 connected at one end to the crank 125 by a pivot 127, and at its other end to the rod 121 by a pivot 128.

The connecting rod and the crank extend in planes parallel to the rod 121. The rotation of the shaft 123, and hence of the shaft 140, causes the rotation of the crank 125 and hence the movement of the body 5 along the bar or rod 121 (arrow O).

Advantageously, one or more springs 9 extend between the pivot 128 and the body 5 in order at least partially to compensate the effect of gravity.

The device according to the invention comprises a control system which is external to the sphere. This control system controls the power supply to the geared motor 150 via a cable 129. This cable is in fact connected to a junction box 141 from which two wires 142 run to feed the geared motor, and wires 143, 144, 145 to an acceleration sensor 77, a synchronisation sensor 76 (position of the connecting-rod/crank system) and a speed sensor 60.

The cable 129 also permits the signals from the sensors to be transmitted to the control system. The cable 129 likewise permits the device according to the invention as shown in FIG. 6 to move freely on the surface 8.

The control system controls the power supply to the geared motor 150. This power supply sends to the geared motor 150, via the cable 129, a current whose voltage varies between 0 and 24 V; giving an error on the motor speed of less than $\pm 0.5\%$, this does not mean that the voltage is constant. This power supply is of the type providing two-quadrant regulation, that is to say of the type enabling the speed of rotation to be braked or accelerated, the direction of rotation still remaining the same.

Figure 7:
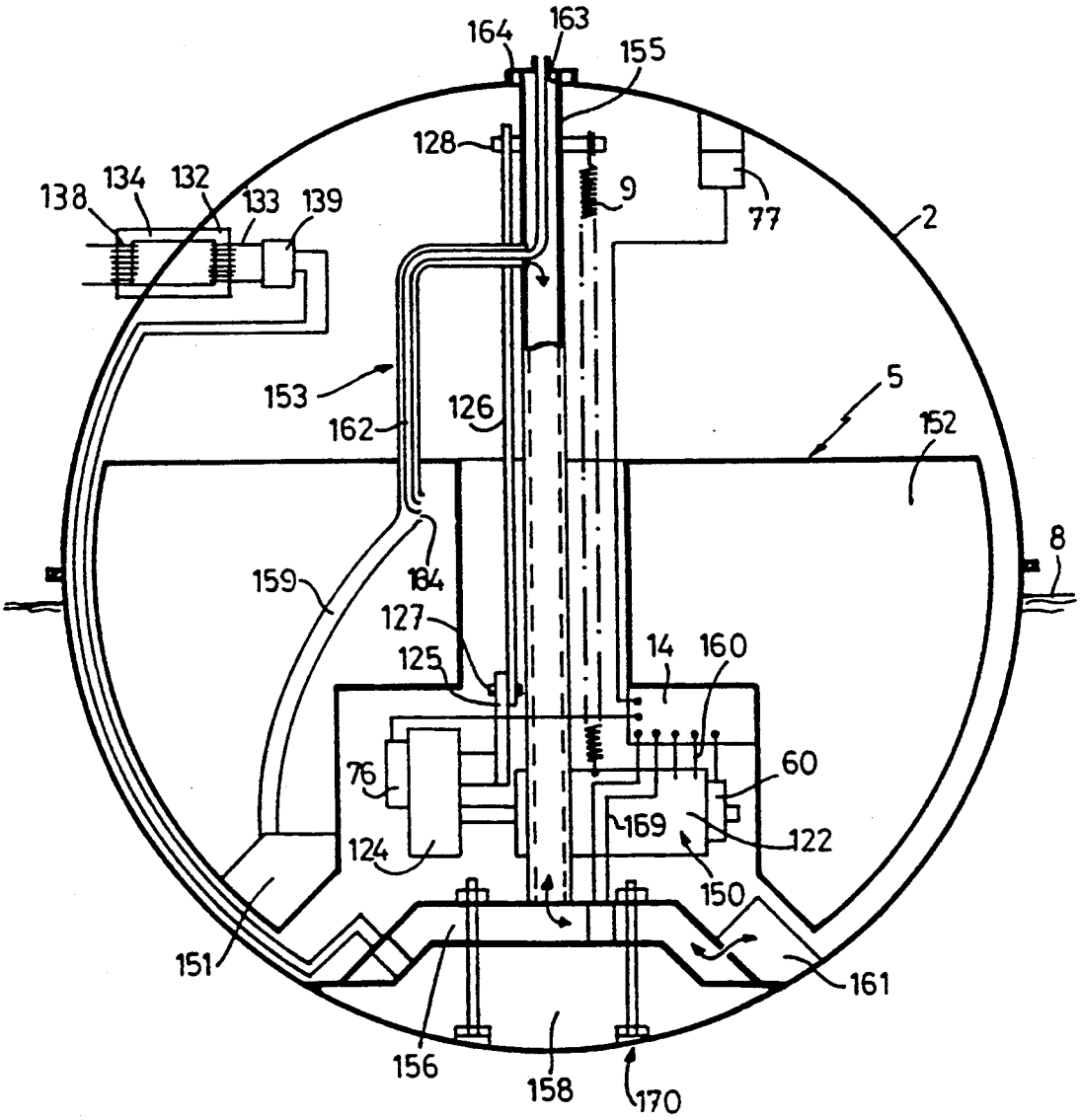
FIG. 7 is a view of a last form of embodiment of a device according to the invention.

The device according to the invention as shown in FIG. 7 comprises a spherical shell 2 in which moves a body 5 having a central aperture allowing the passage of a guide member 155 solidly fixed to the spherical shell 2, the said member having the shape of a sleeve.

The body 5 comprises:

a chamber 152 intended to be filled with water in a manner such as to increase the weight of the body 5;

the geared motor 150 which drives a crank 125 connected by a pivot 127 to a connecting rod 126, one end of which is connected to a pivot 128 solidly fixed to the guide member 155;

the control system 14, and a pump 151 intended to drain the chamber 152.

The spherical shell 2 possesses in its lower part a cavity in which there is accommodated a battery 158 intended to supply current to the device according to the invention, and to the pumps for draining 151 and filling 161 the chamber 152. This battery is fixed to the shell 2, for example, by means of threaded rods and bolts 170.

The device is equipped with a means 9 for at least partially compensating the action of gravity on the body 5. This means 9 is constituted by a spring extending between the pivot 128 and the geared motor 150 solidly fixed to the chamber 152.

The filling pump 161 is mounted on the spherical shell 2. In fact, the filling pump 161 and the drainage pump 151 are mutally connected by a duct 153. This duct 153 is constituted by a chamber 156 whose volume corresponds to the free space left in the cavity when the battery 158 is accommodated, by the conduit formed by the sleeve 155 and by a flexible hose 159 extending between the drainage pump 151 and the conduit 155.

In order to permit the filling of the chamber 152 and the drainage thereof, a tube 162 extends between the chamber 152 and the spherical shell 2 in a manner such as to permit air to be evacuated from or admitted into the chamber 152.

In the form of embodiment shown in section in FIG. 7, this tube 162 enters into the duct 153 via a passage presented by the flexible hose 159 and leaves the said duct via the end 163 of the sleeve 155 opposite that adjacent to the battery 158. A lid 164, possessing an aperture which allows the passage of the tube 162, closes the end 163 of the sleeve 155 which is opposite to that adjacent to the battery 158.

The passage provided by the flexible hose 159 for introducing the tube 162 into the duct 153 preferably has a passage surface area greater than the surface area of the cross-section of the tube 162, in a manner such as to permit a communication 184 between the duct 153 and the upper part of the chamber 152. This communication 184, which is of small size relative to the cross-section of the hose 159, makes it possible to avoid any siphon effect of the duct 153.

The operations of filling and draining the chamber 152 will be briefly described below.

To fill the chamber 152, the pump 161 forces water into the chamber 156 and feeds this water via the duct 153 into the chamber 152. This water leaves via the drainage pump 151, which is not actuated. During this operation, the air present in the chamber 152 is evacuated via the tube 162. It should be noted that once virtually all the air is evacuated, the operation of the pump 161 allows the passage of water via the tube 162. This water then emerges from the end adjacent to the lid 164. In this manner, a device according to the invention equipped with a fountain is obtained.

When the pump 161 is no longer actuated, the communication makes it possible to avoid the emptying of the chamber 152 by a siphon effect.

In order to drain the chamber 152, the pump 151 is actuated (pump 161 stopped). This pump 151 forces the water in the duct 153 towards the pump 161, this water leaving via this pump 161.

The control system 14 receives signals from a speed sensor 60 for the motor 122 driving the reducing gear 124, from a synchronisation sensor 76 and from an acceleration sensor 77.

The current provided by the battery 158 is fed to the control system via the wires 169. This current is modified by the control system 14 before being fed via the wires 160 to the motor 122 driving the reducing gear 124.

The battery 158 can be recharged by a current passing through a magnetic coupling. In order to effect this magnetic coupling, the shell comprises half of a magnetic circuit 132, a coil 133 being wound around this half of the magnetic circuit 132, this coil being connected via a rectifier (incorporating its electronics) 139 to the battery 158.

In order to recharge the battery 158, all that is necessary is to place the other half 134 of the magnetic circuit opposite the half 132 of the said circuit and to connect the coil 138 of this other half 134 to an alternating current source.

Figure 8:
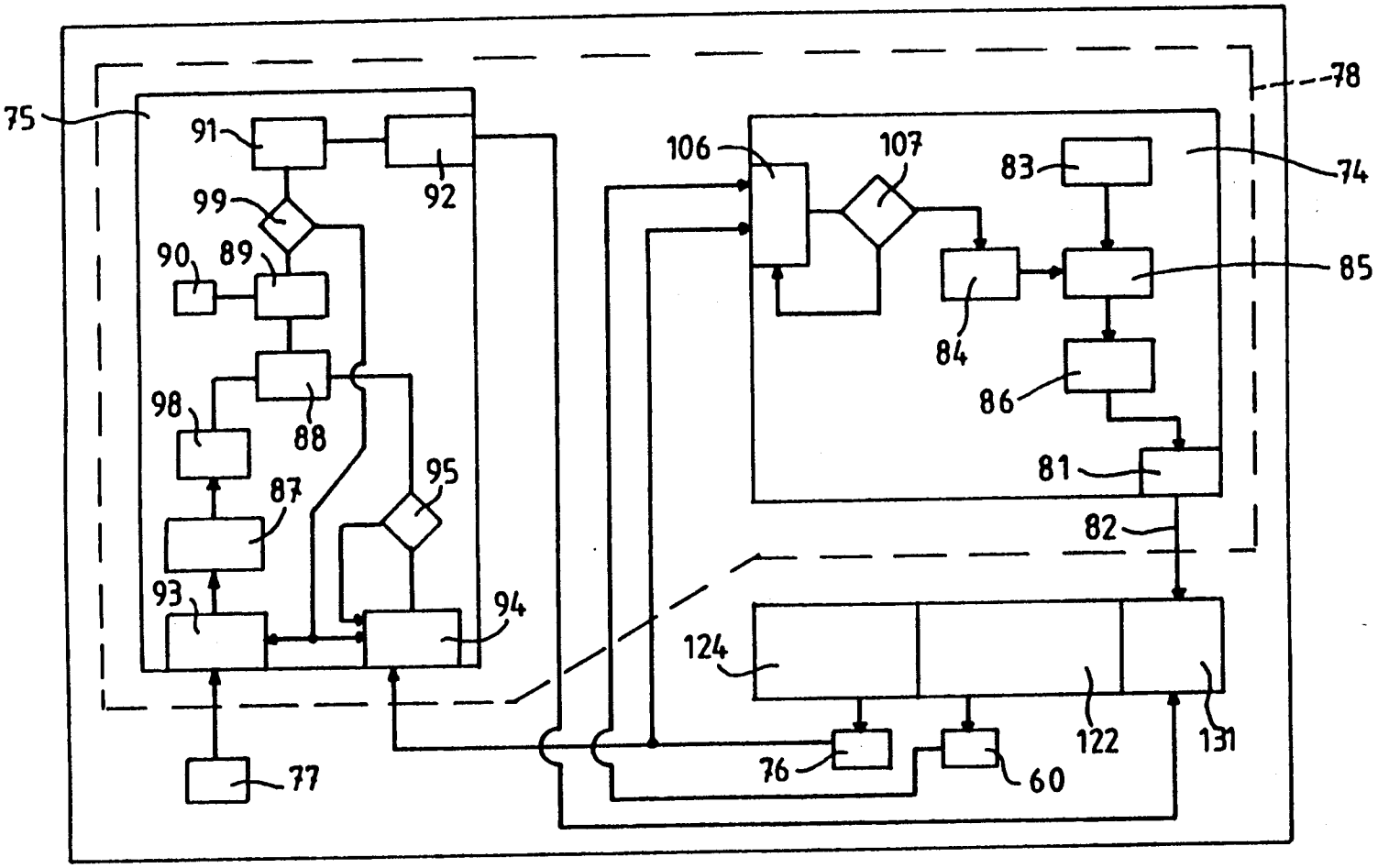
FIG. 8 shows diagrammatically a particular system for controlling the movement of the bodies relative to one another.

FIG. 8 shows a system for controlling the movement of the bodies relative to one another.

This control system comprises:

a unit 74 for controlling the speed of the geared motor (machine control), which unit is intended to modify the power supply to the geared motor in order to obtain a speed of rotation thereof, (for example speed of rotation of the shaft 140 of the reducing gear: 20 to 60 r.p.m.) close to the desired speed (for example within ±0.5%), and, a unit 75 intended to control the phase of the mutual movement of the bodies relative to the phase of the motion created in the liquid or at the surface thereof (system control).

The speed control unit 74 is connected to a speed sensor 60 for the motor 122 driving the reducing gear, and to a synchronisation sensor 76 for the shaft of the geared motor 124, that is to say of the connecting-rod/-crank system.

The phase control unit 75 is connected to an acceleration sensor 77 and to the synchronisation sensor 76.

The control device comprising a speed control unit 74 and a phase control unit 75 advantageously forms part of an electronic chip or a microprocessor 78 shown in broken lines.

The electronic chip or microprocessor 78 emits a signal to the power supply 131 of the motor 122 driving the reducing gear 124.

The speed control unit 74 for the motor comprises:

a memory 81 for an index value of the speed of the geared motor, which value is transmitted via the cable 82 to the power supply 131;

a memory 83 for the value of the desired period of the geared motor;

a read stage 106 for the signals coming from the sensors;

a test 107 for determining if the revolution of the geared motor has ended; if not, execution returns to the read stage 106;

a unit 84 for processing the signals coming from the speed sensor 60 and from the synchronisation sensor 76, which unit is intended to determine the average period of the geared motor (average over a plurality of revolutions of the geared motor);

a unit 85 for determining the deviation existing between the average period determined by the unit 84 and the value of the period in the memory 83, and a unit 86 for modifying the index value in the memory 81 as a function of the measured deviation (for example by incrementing or decrementing the index value by a value equal to the deviation multiplied by a constant), in a manner such as to obtain a regulation of the speed of the motor.

The phase control 75 comprises:

a read stage 93 for signals coming from the acceleration sensor 77 and a read stage 94 for the signals from the synchronisation sensor 76;

a test 95 for determining if the revolution of the geared motor has ended; if not, execution returns to the read stage 94;

a unit 87 for processing signals coming from the accelerometer 77, this unit 87 determining the period of a wave, the average period of the waves (average over a determinate period of time), and the minimum and maximum amplitudes of the waves, this unit making it possible to determine by means of these values the moment at which the wave passes through a determinate state;

a unit 98 detecting the resonance frequency of the waves (for example by Fourier or Hamilton transform);

a unit 88 determining the average speed of the geared motor and its period, and comparing the moment at which the wave passes through a determinate state (for example, the state in which the wave attains its mean level) and the moment at which the connecting-rod/crank system passes through an extreme state, that is to say a unit determining the difference which exists between the phase of the geared motor and the phase of the wave;

a unit 89 for processing the phase differences determined by the unit 88, this unit 89 determining an average phase difference and comparing this average phase difference with the index value in a memory 90;

a test 99 in which the speed (frequency of rotation) of the geared motor is compared with the resonance frequency of the waves, and in which the amplitude of the waves is compared with a predetermined value (10 cm*), if the difference between the speed of the geared motor and the resonance frequency is less than 5%, or if the amplitude is greater than the predetermined value, the value of the average phase difference is sent to the system 91, while in other cases execution returns to the read stages 93, 94 for another phase control cycle;

*: about 10% of the diameter of the spherical shell a system 91 modifying an index value for the speed of the motor in a memory 92, which index value is transmitted to the power supply 131 of the geared motor, the control cycle then recommencing at the read stages 93, 94.

This system 91 determines the direction of speed correction (increase or decrease in speed), and the variation in speed necessary to compensate for the phase difference this variation the minimum value between a predetermined maximum variation and the product of a gain times the measured phase difference.

This system includes a gate intended, when too many corrections are made in the same direction, to modify the base speed of the geared motor.

It will be noted that the electronic chip or microprocessor may possess a unit intended to modify the desired values of phase difference (memory 90) and speed (memory 83) in order to change the mode of motion of the waves or in order to move the device according to the invention in a swimming pool, in particular at the surface thereof. In fact, the movement of the device may be obtained by creating variations in phase difference.

Figure 9:
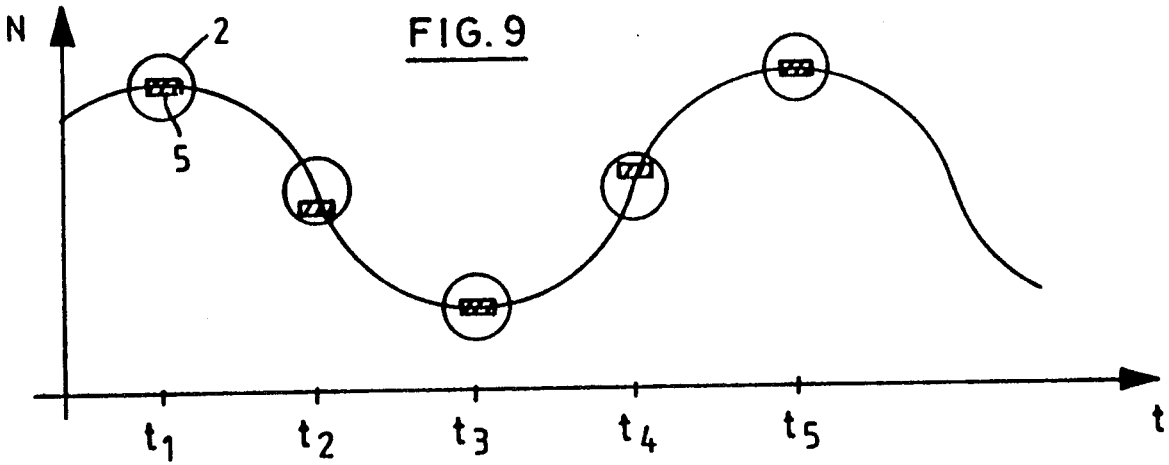
FIGS. 9 and 10 give, over time, the positions of the bodies relative to one another and the level N at which the device according to the invention is situated, the position of the bodies relative to one another in FIG. 9 being one quarter-cycle ahead (phase separation of one quarter-period) relative to the level N at which the device is situated, in a manner such as to obtain maximum waves or agitation, whereas in FIG. 10 the position of the bodies relative to one another is brought back to a position one quarter-cycle ahead relative to the level N at which the device is situated.
Figure 10:
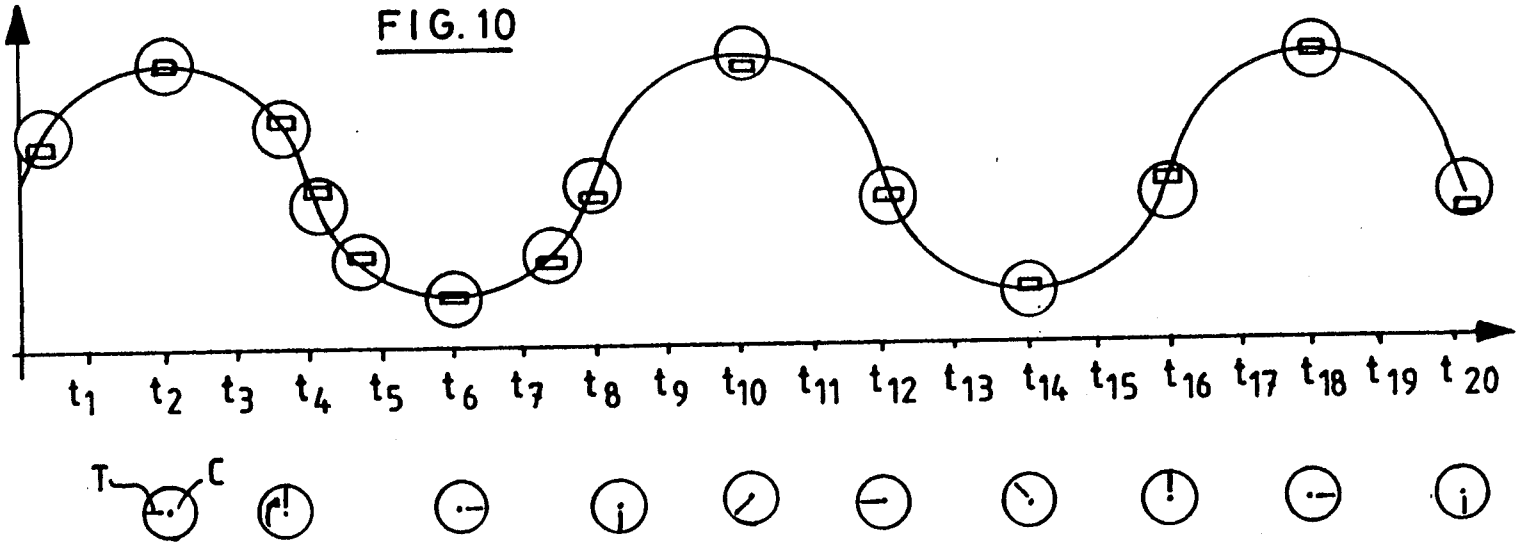

FIGS. 9 and 10 show, over time, the position of the bodies relative to one another, and the level N at which the device according to the invention is situated.

FIG. 9 shows the position of the bodies relative to one another in order to obtain waves of maximum amplitude. As will be noted, the body 5 moving relative to the shell 2 is advanced in phase by 90°, that is to say that the body 5 is in its central position when the device according to the invention is at the maximum or minimum level of a wave (times $t_1$, $t_3$, $t_5$) and is in an extreme position when the device is at the mean level (times $t_2$, $t_4$). In fact, the body 5 is in the extreme lower position at a moment $t_2$ which is a quarter of a period before the wave attains its minimum level (time $t_3$).

If it is desired to damp waves in a swimming pool rapidly, the phase of the mutual movement of the bodies is modified so that the said movement is one quarter-cycle behind relative to the motion of the waves.

In FIG. 10, the device according to the invention lags in phase by 90° (one quarter-cycle behind) relative to the wave. At time $t_2$ the body 5 is in the central position, while the level of the wave is the maximum level. At time $t_3$, the level is an intermediate level between the maximum level and the mean level, while the body 5 has moved towards the apex of the shell 2. At time $t_4$, the body 5 is close to the apex of the shell 2, while the device is at an intermediate level between the maximum level and the mean level. At time $t_5$, the body 5 descends and reaches the central position at time $t_6$. The level is the minimum level at time $t_6$.

In order to restore the situation whereby the device according to the invention leads in phase by 90° (situation shown in FIG. 10), the speed of rotation of the motor is modified at time $t_8$ (the moment at which the connecting-rod/crank position is an extreme position - bottom dead center - the position shown in FIG. 6). In FIG. 10, the position of the crank has again been shown over time. In this illustration, the point C is the crank-/connecting-rod link, while the line T is the position of the crank relative to the point C.

In fact, in the case shown in FIG. 10, the speed of rotation of the motor has been reduced by a factor of two at time $t_8$, so that after a half-revolution of the crank the body 5 is adjacent to the apex of the shell 2, while the device is at the mean level (time $t_{18}$). Between times $t_8$ and $t_{15}$, the body 5 passes from a position adjacent to the bottom of the shell 2 to a position adjacent to the apex of the shell 2.

At time $t_{16}$, the normal speed rotation of the motor is re-established.

The present invention also relates to an assembly emitting a signal at the moment at which a body, in particular a floating body, has to be pushed in a liquid in which, or at the surface of which, a motion is to be created.

Such an assembly is advantageously mounted in a device according to the invention. However, such an assembly may likewise be used to determine the moment at which a swimmer is to submerge a floating body in order to obtain a motion, in particular at the surface of a swimming pool.

Figure 11:
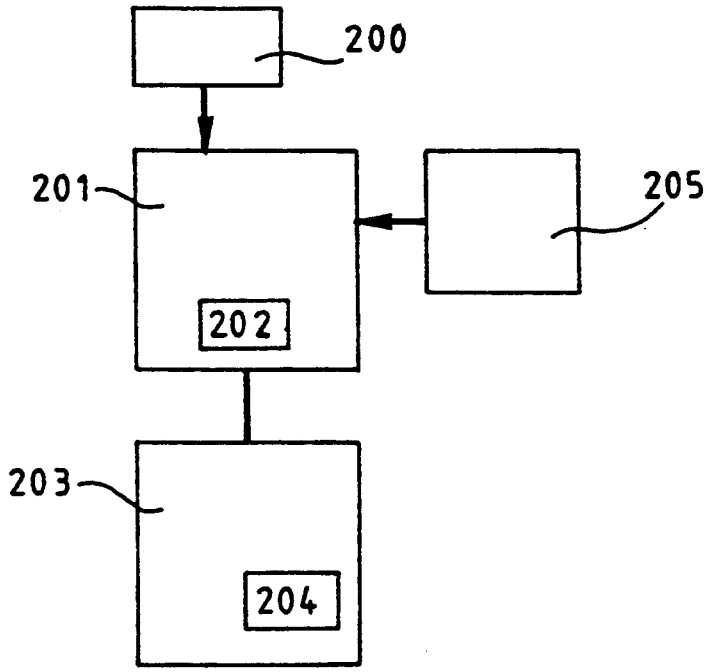
FIG. 11 is a diagrammatic view of an assembly emitting a signal at the moment when a body, in particular a floating body, has to be pushed in a liquid in which, or at the surface of which, a motion is to be created.

This assembly comprises an acceleration sensor 200 connected to an electronic chip or a microprocessor 201 (see FIG. 11).

By virtue of the signals sent by the acceleration sensor 200 to the electronic chip or microprocessor 201, the period and the minimum and maximum levels of the wave, and the moment at which a wave of the motion at the surface of the liquid, or a motion in the latter, passes through a specified state (in particular, in the case of a swimming pool, the state in which the wave attains the mean level) can be determined. By means of these values, the chip 201 determines by a search stage 202 resonance frequencies of the waves in the swimming pool or tank. This search stage can take place by means of a Fourier or Hamilton transform.

When a resonance frequency is determined, the chip determines the period of resonance of the wave and determines the moment at which the floating body has to be pushed. The chip then emits a signal to a warning system 203. Such a signal is for example a sound, a light signal, etc., which warns a swimmer that he has to push, possibly submerge, the body in the water.

Advantageously, the warning system 203 comprises a unit 204 which advances the emission of the signal relative to the moment of pushing, to take into account the swimmer's response time.

This corresponds to the particular case of the device shown in FIG. 6, where the chip determines the period of the motor in order to obtain or approach the calculated resonance period of the wave (deviation of 0.5%). This period value for the motor is stored in the memory 83 of the speed control unit 74.

Finally, the floating body may likewise comprise a pressure sensor 205 intended to determine the force exerted by the swimmer during the pushing of the body. The pressure may be measured by using a floating body of flexible material. In this manner, the force exerted by the swimmer causes a deformation of the body and consequently causes a variation in the volume of the floating body and hence of the pressure prevailing within the latter. This pressure measurement is sent to the electronic chip in order for this variable to be taken into consideration in determining the moment of pushing the body in order to obtain a wave of maximum amplitude.

It is self-explanatory that many modifications can be made to the device according to the invention.

Thus, the energy necessary for the operation of the device according to the invention can be supplied by batteries, solar cells, batteries which can be recharged, for example, by magnetic coupling, etc.

The control system for the device according to the invention can be situated outside or inside the device according to the invention. The device can be equipped with a transmitter-receiver for signals, for example radio waves, etc., the said signals being picked up or emitted by a transmitter-receiver connected to a microprocessor.

Figure 5:
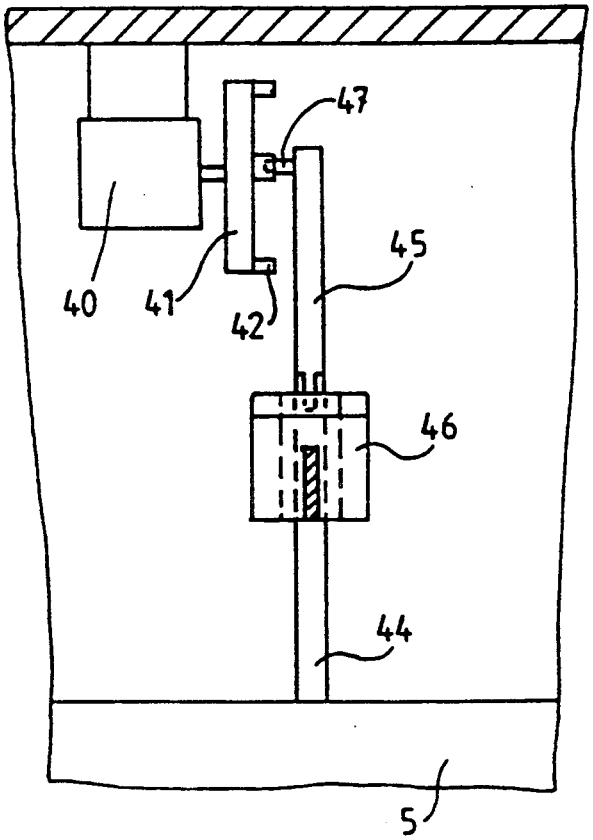
FIG. 5 is a partial view along the line V—V of the device shown in FIG. 3.

For tanks of small dimensions (for example up to 50 $m^2$ surface area) the energy necessary to obtain large-amplitude waves with the aid of the device shown in FIG. 5 (diameter of the spherical shell ±0.75 m) was of the order of 100 watts. This energy may be reduced to approximately 40 watts when low-amplitude waves are to be obtained. (Total weight of the device: ±100 kg.)

The device according to the invention may be used in closed or semi-closed tanks allowing resonant motions to be obtained, such as swimming pools, marinas, ornamental ponds, settling tanks, water purification tanks, sludge treatment tanks etc., and in chemical processes, etc.

Preferably, the motion of the bodies relative to one another is vertical. However, this motion could have been horizontal. This motion may be continuous or intermittent, in accordance with a sinusoidal or pulse mode.

Finally, in the case of the swimming pool, it may be advantageous to place singularities (blocks) along the walls so as to reduce the depth of the pool along these walls and thus to limit the height of the waves along the walls.

Experiments have likewise shown that the motions in the vicinity of the bottom of a swimming pool are very specific, and that these motions allow dirt to accumulate at precise points on the bottom. This thus facilitates the cleaning of the pool, since the dirt is localised at determinate points.

These experiments have likewise shown that it was possible to obtain different types of waves (different possible to obtain different types of waves (different modes, such as single waves, etc) as a function of the excitation (continuous or intermittent, in accordance with a sinusoidal or pulse mode).

A strain gauge may be used as an accelerometer, said gauge expressing the movement of a charge.

What I claim is:

1. Device for creating a motion selected from the group consisting of a motion in a liquid and a motion at the surface of a liquid, this liquid being contained within a space selected from the group consisting of a tank defined by one or more walls and a swimming pool, this device comprising an element in contact with the liquid for which the motion is to be created, said element being an assembly selected from the group consisting of a floating assembly and a submerged assembly, said assembly being mechanically unattached to any wall of the space and comprising first and second bodies mutually connected by at least one displacing means for displacing the bodies relative to one another in a manner such as to create the motion, said device further comprising a control system for controlling the movement of the bodies relative to one another, this control system comprising a speed control unit for controlling the speed of the movement of the bodies relative to one another and a phase control unit for controlling the phase of the movement of the bodies relative to one another relative to the phase of the motion.

2. Device according to claim 1, in which the first body is a shell within which the second body moves.

3. Device according to claim 2, which comprises a means for at least partially to compensating the gravity effect of the second body on the first body.

4. Device according to claim 1, which comprises a compensating means for at least partially to compensating the gravity effect of the second body on the first body, said compensating means being constituted by a resilient element placed between the bottom of the first body and a face of the second body.

5. Device according to claim 4, in which said compensating means is a spring, one end of which bears on the bottom of the first body, while a face of the second body substantially parallel to said bottom rests on the other end of the spring.

6. Device according to claim 1, in which the first body is a vessel having a bottom wall, connected to the second body by a jack, the movement of a stem of said jack causing the movement of the bodies relative to one another.

7. Device according to claim 1, in which the means for displacing the bodies relative to one another comprises, firstly, a geared motor driving a shaft to rotate and, secondly, a strap or a cable extending between said shaft and the second body, said geared motor being mounted on a plate carried by an upper rim of body.

8. Device according to claim 1, in which the means for displacing bodies relative to one another comprises, firstly, a geared motor driving in rotation a disk carrying at least one member possessing a groove and, secondly, a stem fixedly connected to the body second on which is articulated an arm carrying at its free end a finger to be engaged in the groove during part of the rotation of the disk, said geared motor being fixedly connected to a plate bearing on an upper rim of the first body.

9. Device according to claim 1, in which said displacing means comprises a geared motor carried by one body, said geared motor driving in rotation a crank connected to a connecting rod, said connecting rod being connected by a pivot to the other body.

10. Device according to claim 9, in which the geared motor is a variable-speed geared motor.

11. Device according to claim 1 in which the displacing means is a means selected from the group consisting of means possessing a production unit for compressed fluid, and a container for compressed fluid, said fluid being selected from the group consisting of liquid and gas and being actionable on at least one element selected from the group consisting of the bodies and the displacing means in a manner such as to move the bodies relative to one another.

12. Device according to claim 6, in which the jack possesses an end equipped with a trap capable of pivoting about a shaft which is not located along an axis of symmetry of the trap, the closing of said trap being provided by a latch, so that, when the latter no longer acts on the trap, the action of gravity on the second body causes a pivoting of the trap.

13. Device according to claim 1, in which said control system comprises at least one sensor selected from the group consisting of an amplitude sensor for evaluating the amplitude of the waves, a movement sensor for evaluating the movement of the bodies relative to one another, a depth sensor for evaluating the depth of the first body, an accelerometer and a pressure sensor.

14. Device according to claim 13, in which the amplitude sensor is an echo depth sensor.

15. Device according to claim 9, in which the speed control unit and the phase control unit are connected to a speed sensor generating a frequency proportional to the speed of the geared motor, a synchronisation sensor emitting a signal when the connecting-rod/crank system reaches an extreme position, and an acceleration sensor.

16. Device according to claim 15, which comprises an electronic element selected from the group consisting of an electronic chip and a microprocessor, said electronic element receiving signals from the speed sensor, from the synchronisation sensor and from the acceleration sensor, and emitting a signal controlling a power supply to the geared motor which is a variable speed motor.

17. Device according to claim 16, which comprises an electronic element selected from the group consisting of an electronic chip and a microprocessor, said electronic element receiving signals from the sensor of the speed of the geared motor, from the sensor of the synchronisation of the connecting-rod/crank system and from the acceleration sensor, and emitting a signal controlling a power supply to the geared motor which is a variable speed motor, in which said electronic chip or microprocessor controls the power supply to the geared motor in a manner such as to permit regulation of the speed of the geared motor.

18. Device according to claim 16, which comprises an electronic element selected from the group consisting of an electronic chip and a microprocessor, said electronic element receiving signals from the sensor of the speed of the geared motor, from the sensor of the synchronisation of the connecting-rod/crank system and from the acceleration sensor, and emitting a signal controlling a power supply to the geared motor which is a variable speed motor, in which said electronic chip or microprocessor comprises a memory for an index value of the speed of the geared motor for each revolution, a memory for the desired period of the geared motor, a unit for determining the average period of the geared motor over a plurality of rotations, a unit for determining the existing deviation between the average period and the desired period, and a unit for modifying the geared motor speed index memory as a function of the measured deviation in a manner such as to permit regulation of the speed of the geared motor.

19. Device according to claim 16, which comprises an electronic element selected from the group consisting of an electronic chip and a microprocessor, said electronic element receiving signals from the sensor of the speed of the geared motor, from the sensor of the synchronization of the connecting-rod/crank system and from the acceleration sensor, and emitting a signal controlling a power supply to the geared motor which is a variable speed motor, in which said electronic chip or microprocessor comprises:

a processing element for signals coming from the acceleration sensor in which a mean value of the said signals over a determinate period of time and the minimum and maximum values of the signals are determined, and which, by means of these values, the moment is determined at which a wave at the surface of the liquid or a motion in the liquid passes through a predetermined state, a unit measuring the deviation between said moment and the moment when the connecting-rod/crank system passes through an extreme state, and a system comparing this deviation or mean deviation with an optimum deviation and emitting a signal to the power supply of the geared motor, in a manner such as to direct the difference existing between the mean deviation and the optimum deviation, that is to say the moment at which the connecting-rod/-crank system passes through an extreme state.

20. Device according to claim 16, which comprises an electronic element selected from the group consisting of an electronic chip and a microprocessor, said electronic element receiving signals from the sensor of the speed of the geared motor, from the sensor of the synchronisation of the connecting-rod/crank system and from the acceleration sensor, and emitting a signal controlling a power supply to the geared motor which is a variable speed motor, said electronic chip or microprocessor comprising:

a processing element for signals coming from the acceleration sensor in which a mean value of the said signals over a determinate period of time and the minimum and maximum values of the signals are determined, and which, by means of these values, the moment is determined at which a wave at the surface of the liquid or a motion in the liquid passes through a predetermined state, a unit measuring the deviation between said moment and the moment when the connecting-rod/crank system passes through an extreme state, an element for processing the deviations in a manner such as to determine a mean deviation over a plurality of periods, and a system comparing this deviation or mean deviation with an optimum deviation and emitting a signal to the power supply of the geared motor, in a manner such as to direct the difference existing between the mean deviation and the optimum deviation, that is to say the moment at which the connecting-rod/-crank system passes through an extreme state.

21. Device according to claim 16 which comprises an electronic element selected from the group consisting of an electronic chip or a microprocessor, said electronic element receiving signals from the sensor of the speed of the geared motor, from the sensor of the synchronisation of the connecting-rod/crank system and from the acceleration sensor, and emitting a signal controlling a power supply to the geared motor which is a variable speed motor, said microprocessor comprising:

a unit for receiving signals coming from the acceleration sensor and for determining a mean value of said signals over a determinate period of time, as well as the minimum and maximum values of said signals, and for determining, from said values, the moment at which a wave at the surface of the liquid or a motion in the liquid passes through a predetermined state, a unit deducing from said values resonance periods of the waves or of the motion in the liquid, and a system emitting a control signal in order to obtain a movement of the liquid having a period close to one of the said resonance periods.

22. Electronic device for a device according to claim 16, which comprises an electronic element selected from the group consisting of an electronic chip or a microprocessor, said electronic element receiving signals from the sensor of the speed of the geared motor, from the sensor of the synchronisation of the connecting-rod/crank system and from the acceleration sensor, and emitting a signal controlling the power supply to the geared motor which is a variable speed motor, said electronic device comprising an accelerometer and a microprocessor comprising:

a unit for receiving signals coming from the accelerometer for determining the period and the minimum and maximum levels of the wave of the movement, a unit deducing from said values resonance periods of the waves or of the motion in the liquid, and a system emitting a control signal in order to obtain a movement of the liquid having a period close to one of the said resonance periods.

23. A method of using an electronic device in said device of claim 9 for obtaining a predetermined movement of the wave, said electronic device comprising an accelerometer and a microprocessor, said method comprising:

receiving signals coming from the accelerometer for determining the period and the minimum and maximum levels of the wave of the movement, deducing from said values resonance periods of the waves or of the motion in the liquid, and providing a system emitting a control signal in order to obtain a movement of the liquid having a period close to one of the said resonance periods.

24. A method of using a device according to claim 9 for obtaining waves having a maximum amplitude, said method comprising:

providing an electronic device comprising an accelerometer and a microprocessor, receiving signals coming from the accelerometer for determining the period and the minimum and maximum levels of the wave of the movement, deducing from said values resonance periods of the waves or of the motion in the liquid, and providing a system emitting a control signal in order to obtain a movement of the liquid having a period close to one of the said resonance periods.

25. Device for creating a motion selected from the group consisting of a motion in a liquid and a motion at the surface of a liquid, this liquid being contained within a space selected from the group consisting of a tank defined by one or more walls and a swimming pool, this device comprising an element in contact with the liquid for which the motion is to be created, said element being an assembly selected from the group consisting of a floating assembly and a submerged assembly, said assembly being non-rigidly attached to a wall of the space and comprising first and second bodies mutually connected by at least one displacing means for displacing the bodies relative to one another in a manner such as to create the motion, said device further comprising a control system for controlling the movement of the bodies relative to one another, this control system comprising a speed control unit for controlling the speed of the movement of the bodies relative to one another and a phase control unit for controlling the phase of the movement of the bodies relative to one another relative to the phase of the motion.

* * * * *